US009932658B2

(12) United States Patent
Shishido et al.

(10) Patent No.: US 9,932,658 B2
(45) Date of Patent: Apr. 3, 2018

(54) ALUMINUM ALLOY HAVING EXCELLENT CHARACTERISTIC AFTER NATURAL AGING AT ROOM TEMPERATURE

(71) Applicant: Kobe Steel, Ltd., Kobe-shi (JP)

(72) Inventors: Hisao Shishido, Kobe (JP); Katsushi Matsumoto, Kobe (JP); Yasuhiro Aruga, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 66 days.

(21) Appl. No.: 14/765,987

(22) PCT Filed: Feb. 24, 2014

(86) PCT No.: PCT/JP2014/054340
§ 371 (c)(1),
(2) Date: Aug. 5, 2015

(87) PCT Pub. No.: WO2014/132925
PCT Pub. Date: Sep. 4, 2014

(65) Prior Publication Data

US 2015/0368761 A1 Dec. 24, 2015

(30) Foreign Application Priority Data

Feb. 26, 2013 (JP) ..... 2013-035986

(51) Int. Cl.

| | |
|---|---|
| ***C22C 21/16*** | (2006.01) |
| ***C22C 21/02*** | (2006.01) |
| ***C22F 1/05*** | (2006.01) |
| ***C22C 21/08*** | (2006.01) |
| ***C22C 21/00*** | (2006.01) |
| ***C22C 21/10*** | (2006.01) |
| ***C22C 21/14*** | (2006.01) |

(52) U.S. Cl.
CPC ..... *C22C 21/16* (2013.01); *C22C 21/00* (2013.01); *C22C 21/02* (2013.01); *C22C 21/08* (2013.01); *C22C 21/10* (2013.01); *C22C 21/14* (2013.01); *C22F 1/05* (2013.01)

(58) Field of Classification Search
CPC ..... C22C 21/16; C22C 21/08; C22C 21/14; C22C 21/10
See application file for complete search history.

(56) References Cited

U.S. PATENT DOCUMENTS

| | | | | |
|---|---|---|---|---|
| 6,231,809 | B1 * | 5/2001 | Matsumoto et al. | 420/535 |
| 6,361,741 | B1 | 3/2002 | Klemp et al. | |

FOREIGN PATENT DOCUMENTS

| | | | |
|---|---|---|---|
| JP | 06-2092 | A | 1/1994 |
| JP | 09-249950 | A | 9/1997 |
| JP | 2001-262264 | A | 9/2001 |
| JP | 2002-235158 | A | 8/2002 |
| JP | 2003-301249 | A | 10/2003 |
| JP | 2006-9140 | A | 1/2006 |
| JP | 2006-37139 | A | 2/2006 |

OTHER PUBLICATIONS

International Search Report and Written Opinion dated Apr. 28, 2014, in PCT/JP2014/054340, filed Feb. 24, 2014.

* cited by examiner

*Primary Examiner* — Rebecca Y Lee
(74) *Attorney, Agent, or Firm* — Oblon, McClelland, Maier & Neustadt, L.L.P.

(57) ABSTRACT

A 6000-series aluminum alloy plate, which is obtained by introducing a minor amount of Sn into a 6000-series aluminum alloy plate that has a specific Mg and Si composition, and controlling the tissue of the plate on the basis of the tissue thereof under a specific heat treatment, shows an improved hem bendability even after aging for a long period of time at room temperature, as a characteristic after the natural aging, and increases the bake hardenability (BH response) in baking finishing a molded automobile panel.

9 Claims, No Drawings

ALUMINUM ALLOY HAVING EXCELLENT CHARACTERISTIC AFTER NATURAL AGING AT ROOM TEMPERATURE

TECHNICAL FIELD

The present invention relates to an Al-MG-Si series aluminum alloy plate. The aluminum alloy plate referred to in the present invention is a rolled plate such as a hot rolled plate or a cold rolled plate, which is an aluminum alloy plate after applied with heat refining such as solution treatment and quenching treatment and before artificial age hardening such as press forming or paint bake hardening treatment. Further, aluminum is referred to also as Al in the following description.

BACKGROUND ART

In recent years, a social demand to weight reduction of vehicles such as automobiles has been increased more and more considering global environments. In order to cope with such demand, use of aluminum alloy materials of further reduced weight excellent in formability and paint bake hardenability has been increased, instead of iron and steel materials such as steel sheets, as a material for automobile panels, in particular, large body panels such as hoods, doors, roofs (outer panels and inner panels).

Among them, as panels such as outer panels (outer plates) and inner panels (inner plates) of panel structures, for example, hoods, fenders, doors, roofs and trunk lids of automobiles, use of Al—Mg—Si series AA or JIS 6000-series (hereinafter simply referred to as 6000-series) aluminum alloy plates has been under investigation as thin and high strength aluminum alloy plates.

The 6000-series aluminum alloy plates essentially contain Si and Mg and, particularly, excess Si 6000-series aluminum alloys have a composition with a Si/Mg mass ratio of 1 or greater and have excellent aging hardenability. Accordingly, they ensure formability by reduction of a yield strength in press forming and bending and have paint bake hardenability in which they are age-hardened by heating during artificial aging (hardening) such as paint baking treatment after press forming of the panel capable of increasing the yield strength and ensuring strength necessary as the panel (hereinafter also referred to as bake hardenability=BH response, bake hardenability).

In contrast, as is well-known, outer panels of automobiles are manufactured by applying press forming such as stretch forming and bending in combination in press forming to aluminum alloy plates. For example, in a large outer panel such as a hood or a door, the plate is press formed, for example, by stretch forming into the shape of a formed product as an outer panel and then bonded with an inner panel by hem working (hemming), for example, flat hemming at the periphery of the outer panel to form a panel structure.

The 6000-series aluminum alloy is advantageous having excellent BH response but, on the contrary, involves a subject of having a natural aging property of deteriorating the formability to a panel, particularly, bendability since it is age-hardened to increase the strength after being held at a room temperature for several months after solution and quenching treatments. For example, when a 6000-series aluminum alloy plate is used to an automobile panel, the plate is usually left put to a room temperature for about 1 to 4 months (left at room temperature) after the solution and quenching treatments by an aluminum manufacturer (after production) and before press formation into a panel by an automobile manufacturer in which the plate is age hardened considerably (natural aging at room temperature). Particularly, in an outer panel subjected to severe bending, while the panel can be formed with no trouble just after production, it involves a problem, for example, of causing cracking during hem working after age hardening (natural aging).

Further, when such natural aging is large, this also results a problem that the BH response is lowered and the yield strength is not improved to a strength necessary as the panel even by heating during an artificial ageing (hardening) treatment such as a paint baking treatment of the panel after the press forming described above.

Accordingly, various proposals have been made so far for improving the BH response and suppressing the natural aging of the 6000-series aluminum alloys. For example, Patent Literature 1 proposes suppression of change of strength in the course after lapse of seven days to 90 days at a room temperature after production by changing the cooling rate stepwise in the solution and quenching treatments. Further, Patent Literature 2 proposes to obtain a BH response and a shape fixability by keeping the alloy at a temperature of 50 to 150° C. for 10 to 300 minutes within 60 minutes after the solution and quenching treatments. Further, a Patent Literature 3 proposes to obtain the BH response and the shape fixability by defining the cooling temperature at the first stage and the subsequent cooling rate in the solution and quenching treatment. Further, Patent Literature 4 proposes to improve the BH response by a heat treatment after the solution and quenching treatments.

Further, many methods of positively adding Sn as the component to suppress the natural aging and improve the bake hardening have been proposed, for example, by Patent Literatures 5 to 11. For example, the Patent Literature 5 proposes a method of providing suppression for the natural aging and bake hardening together by defining the relation of components between Mg and Si as: $-2.0>4Mg-7Si$, adding appropriate amount of Sn having an effect of suppressing aging change, and applying preliminary aging after the solution treatment. Further, the Patent Literature 6 proposes a method of defining the relation of components between Mg and Si as: $-2.0\leq 4Mg-7Si\leq 1.0$, adding Sn having an effect of suppressing aging change and Cu of improving the formability, and applying galvanization, thereby improving the formability, bake hardenability, and corrosion resistance.

CITATION LIST

Patent Literature

Patent Literature 1: Japanese Unexamined Patent Application Publication No. 2000-160310

Patent Literature 2: Japanese Patent No. 3207413

Patent Literature 3: Japanese Patent No. 2614686

Patent Literature 4: Japanese Unexamined Patent Application Publication No. H04(1992)-210456

Patent Literature 5: Japanese Unexamined Patent Application Publication No. H09(1997)-249950

Patent Literature 6: Japanese Unexamined Patent Application Publication No. H10(1998)-226894

Patent Literature 7: Japanese Unexamined Patent Application Publication No. H07(1995)-207396

Patent Literature 8: Japanese Unexamined Patent Application Publication No. H08(1996)-109428

Patent Literature 9: Japanese Unexamined Patent Application Publication No. H09(1997)-53161

Patent Literature 10: Japanese Unexamined Patent Application Publication No. H10(1998)-219382

Patent Literature 11: Japanese Unexamined Patent Application Publication No. 2002-301249

SUMMARY OF INVENTION

Technical Problem

In recent years, aluminum alloy plates more excellent in the formability than usual have been demanded in order to realize beautiful curved surface configuration and character lines with no strains in automobile panels with a view point of designability. For this demand, the prior arts described above were insufficient in the formability.

The present invention has been accomplished in order to solve the problems in the prior arts described above and intends to provide a 6000-series aluminum alloy plate particularly improved with hem bendability and bake hardenability as characteristics after natural aging in order to cope with more difficult press forming of automobile panels. More specifically, the invention provides a 6000-series aluminum alloy plate with a yield strength of 100 MPa or less after lapse of 100 days at a room temperature and a hardening amount by paint baking (BH response) of 90 MPa or more.

Solution to Problem

For attaining the purpose, the aluminum alloy plate of excellent paint bake hardenability of the present invention has a future in an Al—Mg—Si series alloy plate comprising, based on mass %, Mg: 0.3 to 0.6%, Si: 0.4 to 1.4% and Sn: 0.01 to 0.3%, and satisfying the balance of components between Mg and Si of: 8×(Mg content)−(Si content)≤3.0, with the remainder being Al and unavoidable impurities, in which the number density of precipitates of a size from 2.0 to 20 nm is $5.0\times10^{21}$ N/m$^3$ or more in average when measured within a range of 300 nm×300 nm×100 nm under a transmission electron microscope of 300,000 magnifications for the microstructure at a central portion of a cross section perpendicular to the rolling direction of the plate after artificial aging at 170° C. for 20 minutes.

Advantageous Effects of Invention

In the present invention, a trace amount of Sn is incorporated in an Al—Si—Mg series alloy plate, thereby suppressing a natural aging even after lapse of a long time, improving the hem bendability (formability) and increasing the hardening amount (BH response) by bake finishing of a formed automobile panel.

Sn has an effect of trapping voids at a room temperature thereby suppressing diffusion at the room temperature and suppressing change of strength at the room temperature. Further, since trapped voids are released at a high temperature during bake finishing, diffusion can be promoted conversely to enhance the bake hardenability.

In this regard, Sn is positively added to suppress the natural aging and improve the bake hardenability also in the Patent Literatures 5 and 6. However, in the methods of adding Sn, change of the alloy microstructure due to addition of Sn has not yet been investigated.

The microstructure of the Al—Si—Mg series alloy plate with addition of Sn is greatly different compared with that with no addition of Sn and is also different greatly depending on the method of producing the plate. However, the microstructures cannot be distinguished each other in the stage of a material plate after producing by a usual method of measuring the microstructure such as SEM, TEM or X-ray diffractometry.

Fine precipitates defined in the present invention which can distinguish such structural changes are not formed in the microstructure of the plate unless the plate having the microstructure has been applied with a predetermined heat treatment corresponding to bake hardening. That is, it cannot be distinguished whether the invention can be satisfied or not unless the plate having the microstructure has been applied with a predetermined heat treatment corresponding to bake hardening of the plate as defined in claim 1. In addition, measurement of the fine precipitates needs observation of the microstructure under a transmission electron microscope at high magnifications. Further, such structural change is also concerned greatly with the plate production conditions (greatly undergoing the effect thereof). Even when Sn is added in the same manner, a microstructure having an effect of suppressing the natural aging and improving the bake hardenability cannot always be obtained at a high level of the present invention if the production conditions are different. They are also the reason that the investigation has not been made in the prior arts on the change of the alloy microstructure due to Sn addition has not been investigated in the prior art of adding Sn described above.

The present invention can provide an aluminum alloy plate excellent in the characteristic after the room temperature age hardening that can reduce the yield strength after lapse of 100 days at a room temperature and enhance the hardening amount (BH response) to 90 MPa or more by bake finishing by enabling the control of the microstructure based on the premise of such Sn addition for the first time.

DESCRIPTION OF EMBODIMENTS

Embodiments of the present invention are to be described specifically on every constituent factors.

(Chemical Composition)

Then, the chemical composition of the 6000-series aluminum alloy plate is to be described below. The 6000-series aluminum alloy plate of the present invention is required to have various characteristics such as excellent formability, BH response, strength, weldability, and corrosion resistance as the plate for automobile outer plates, etc. described above. Then, the subject of the 6000-series aluminum alloy plate of the present invention is to have characteristics after natural aging that the yield strength after lapse of 100 days at a room temperature is 100 MPa or less and the hardening amount due to bake finishing (BH response) is 90 MPa or more.

The chemical composition of the aluminum alloy plate as a premise of providing the excellent BH response while suppressing the natural aging is that of the Al—Mg—Si series aluminum alloy plate comprising, on the mass % base, Mg: 0.3 to 0.6%, Si: 0.4 to 1.4%, and Sn: 0.01 to 0.3% and satisfying the balance of components between Mg and Si: 8×(Mg content)−(Si content)≤3.0, with the remainder being Al and unavoidable impurities.

In the present invention, other elements than Mg, Si and Sn are basically unavoidable impurities which are defined as the content at each of the levels of the element according to AA to JIS standards (allowable amount) (Ag is not defined in the standards). That is, with a view point of recycling resources, when a great amount of 6000-series alloys, other aluminum alloy scrap materials, or low purity Al based bare metals containing a great amount of other elements of additive elements (alloying elements) than Mg, Si, and Sn are used in addition to the high purity Al bare metals as dissolution materials for the alloys also in the invention, other elements as described below are essentially intruded each in a substantial amount. Since the refinement per se of intentionally reducing such elements increases the cost, it is necessary for allowing them to be contained to some extent. There is such a range of contents for the elements not deteriorating the purpose and the effect of the present invention if they are contained in substantial amounts.

In this regard, the allowable amounts of other elements than Mg, Si, and Sn are exemplified below. Mn: 1.0% or less (not inclusive 0%), Cu: 1.0% or less (not inclusive 0%), Fe: 1.0% or less (not inclusive 0%), Cr: 0.3% or less (not inclusive 0%), Zr: 0.3% or less (not inclusive 0%), V: 0.3% or less (not inclusive 0%), Ti: 0.1% or less (not inclusive 0%), Zn: 1.0% or less (not inclusive 0%), and Ag: 0.2% or less (not inclusive 0%). One or more of such elements may be incorporated further within the range described above in addition to the basic composition described above. The range of content and meanings or allowable amount of each of the elements in the 6000-series aluminum alloy is to be described below.

Si: 0.4 to 1.4%

Si, together with Mg, is an essential element for obtaining a necessary strength (yield strength) as an outer panel of an automobile by forming aged precipitates that contribute to the improvement of strength upon artificial aging treatment such as solution strengthening and bake hardening treatment to provide aging hardenability. Further, Si is a most important element in the 6000-series aluminum alloy plate of the present invention for providing various characteristics together such as total elongation that affects the press formability.

If the Si content is insufficient, because of deficiency of an absolute amount of Si, the paint bake hardenability is deteriorated remarkably. Further, various characteristics such as total elongation required in respective application uses cannot be provided together. In contrast, if the Si content is excessive, coarse metallic compounds and precipitates are formed to remarkably deteriorate the bendability, total elongation, etc. Further, the weldability is also deteriorated remarkably. Accordingly, Si is defined within a range from 0.4 to 1.4%.

Mg: 0.3 to 0.6%

Mg, together with Si, is also an essential element of forming aging precipitates that contribute, in cooperation with Si, to the improvement of strength in the artificial aging treatment such as solution strengthening and bake hardening treatment thereby providing aging hardenability to obtain necessary yield strength as the panel.

If the Mg content is insufficient, because of the deficiency of the absolute amount of Mg, the bake hardenability is deteriorated remarkably. Accordingly, yield strength necessary for the panel cannot be obtained. In contrast, if the Mg content is excessive, coarse metallic compounds and precipitates are formed to remarkably deteriorate the bendability, the total elongation, etc. Accordingly, the Mg content is defined as within a range from 0.3 to 0.6%.

Balance of Components Between Mg and Si

Mg and Si are defined so as to satisfy the range of each of the contents described above, as well as satisfy: 8×(Mg content)−(Si content) ≤3.0 as a relational formula for the balance between each of the components. For the balance between Mg and Si, it is generally reported that if Si is in excess of the balance of $Mg_2Si$ in the equilibrium precipitation phase, the paint bake hardenability (BH response) is increased. In the present invention, when the Mg content is decreased as low as 0.6% or less with an aim of decreasing the yield strength for improving the formability, reduced yield strength and high BH response can be provided together by satisfying the formula for the balance described above. If the relation for the balance of components is more than 3, sufficient BH response cannot be obtained easily while reducing the yield strength.

Sn: 0.01 to 0.3%

Sn has an effect of trapping voids at the room temperature thereby suppressing diffusion at a room temperature and suppressing the change of strength at the room temperature. Further, since the trapped voids are released at a high temperature upon bake finishing, it can conversely promote diffusion to increase the BH response. The Al—Si—Mg series alloy plate with addition of Sn is structurally different compared to the alloy plate with no addition of Sn. However, since the microstructures are different if the production conditions are different even when Sn is added in the same manner, a microstructure having an effect of suppressing the natural aging and improving the bake hardenability cannot always be obtained at a high level of the present invention.

If the Sn content is insufficient, even when the material plate is produced by a preferred production method to be described later, Sn cannot sufficiently trap the voids and provide the effect, as well as cannot form the microstructure defined in the present invention (fine precipitates). In contrast, if the Sn content is excessive, even when the material plate is produced by the preferred production method to be described later, the microstructure (fine precipitates) defined by the present invention are rather difficult to be formed and Sn segregates to the grain boundary tending to cause grain boundary cracking.

(Microstructure)

In the present invention, based on the premise of the 6000 series aluminum alloy composition described above, the 6000 series aluminum alloy plate microstructure is defined by the microstructure after the heat treatment assuming that the material plate is subjected to a bake hardening treatment after press forming to an automobile panel. That is, the microstructure at a central portion of a cross section perpendicular to the rolling direction of the plate after applying a heat treatment at 170° C. for 20 minutes is defined such that the number density of precipitates of a size of 2.0 to 20 nm within the crystallized grains measured under a transmission electron microscope of 300,000 magnifications is $5.0\times10^{21}$ N/m$^3$ or more in average.

The precipitates are intermetallic compounds comprising Mg and Si which are formed in the crystallized grains only in a case of the heat treatment or the actual bake hardening treatment and, as a matter of course, they cannot be observed for the microstructure of the material plate before the heat treatment (pre-structure) even under TEM of high magnifications. In other words, for the pre-structure of the material plate, it is not possible to judge or structurally distinguish whether the precipitates having such effect have a microstructure or not that can be formed in the crystallized grain upon heat treatment or actual bake hardening treatment described above, even under TEM of high magnifications.

Accordingly, in the present invention, it is judged whether the pre-structure is formed or not for the microstructure after the heat treatment but not for the pre-structure of the plate. The size of the precipitates referred to in the present invention is a circle equivalent diameter of precipitates of an indefinite shape (average diameter).

As described above, when the microstructure of the plate is formed as the pre-structure in which precipitates of a fine size of 2.0 to 20 nm formed in the crystallized grains during the bake hardening treatment are present by a predetermined number density as defined above, hem bendability (formability) can be ensured by a reduced yield strength during press forming and the strength can be enhanced by high BH response upon bake hardening treatment even after long time natural aging. That is, the yield strength after lapse of 100 days at a room temperature can be reduced to 100 MPa or less and the coating amount by bake hardening (BH response) can be 90 MPa or more.

If the pre-structure of the plate is such a microstructure that precipitates of a fine size of 2.0 to 20 nm formed in the crystallized grains during the bake hardening treatment are insufficient, formability can be ensured by a reduced yield strength during press forming but the strength cannot be increased by high BH response upon bake hardening treatment. That is, if the number density of the precipitates of a size of 2.0 to 20 nm within the crystallized grains measured by observation under a transmission electron microscope of 300,000 magnifications is less than $5.0\times10^{21}$ N/m$^3$ in average, the BH response during the bake hardening treatment is insufficient failing to attain a high strength.

By the way, the upper limit of the number density of the precipitates of the size of 2.0 to 20 nm is restricted also by the composition of Sn, etc. and the production limit and the precipitates can be precipitated in the crystallized grains only to about $5.0\times10^{23}$ N/m$^3$ in average as the upper limit. Further, the number density of the precipitates of the size of 2.0 to 20 nm of the present invention cannot be observed or measured because of the excessive fineness under an optical microscope of about 400 magnifications used in the prior arts but can be observed only under a transmission electron microscope at a high magnifying factor of 300,000 magnifications defined as described above.

(Production Method)

Then, a method of producing the aluminum alloy plate according to the present invention is to be described below. The production step per se of the aluminum alloy plate according to the present invention is a customary method or a known method in which the plate is produced by casting an aluminum alloy ingot of the 6000-series composition described above subsequently, subjecting the ingot to a soaking heat treatment and applying hot rolling and cold rolling into a predetermined gauge and, further, applying a heat refining treatment such as solution and quenching.

However, for controlling the microstructure of the present invention during the manufacturing steps in order to improve the BH response, it is necessary to more properly control the solution and quenching treatments, proper quenching (cooling) stop temperature, and holding in the temperature range as will be described later. Further, also in other steps, there are preferred conditions for controlling the microstructure within the defined range of the present invention.

(Cooling Rate in Dissolving and Casting)

First, in the dissolving and casting steps, a molten aluminum alloy dissolved and conditioned within the range of the 6000-series component composition is cast while properly selecting a usual dissolving casting method such as a continuous casting method, a semi-continuous casting method (DC casting method), etc. For controlling the microstructure within the range defined in the present invention, the average cooling rate during casting is preferably set as high (rapid) as possible such as 30° C./min or higher from a liquidus line temperature to a solidus line temperature.

In a case of not controlling the temperature (cooling rate) in a high temperature region during casting, the cooling rate in the high temperature region is naturally lowered. If the average cooling rage is lowered in the high temperature region, the amount of metallic compounds formed coarsely within the temperature range in the high temperature region is increased and the size and the amount of metallic compounds in the direction of the width and the direction of the thickness of ingots are also varied greatly. As a result, a possibility incapable of controlling the microstructure within the range of the present invention may be increased.

(Soaking Heat Treatment)

Then, a soaking heat treatment is applied to the cast aluminum alloy ingot prior to hot rolling. The soaking heat treatment (soaking treatment) intends to homogenize the microstructure, that is, eliminate segregation in the ingot microstructure within the crystallized grains. So long as the conditions can attain the purpose, they are not particularly restricted and usual treatment for once or one step may be applied.

The temperature for the soaking heat treatment is properly selected within a range of 500° C. or higher and lower than the melting point and the soaking time is properly selected from a range of 4 hours or more. If the soaking temperature is lower, since segregation in the crystallized grains cannot be eliminated sufficiently, which acts as triggers of destruction, extension flangeability or bendability such as hem bendability are lowered during press forming. Subsequently, fine precipitates can be controlled to the number density defined in the present invention either by starting hot rolling immediately or by starting the hot rolling after holding the specimen to an appropriate temperature.

After the soaking heat treatment, the slab can be cooled to a room temperature at an average cooling rate of 20 to 100° C./h between 300° C. to 500° C. and then re-heated at an average heating rate of 20 to 100° C./h up to 350° C. to 450° C. and hot rolling can be started in the temperature region. If the conditions are out of the range for the average cooling rate after the soaking heat treatment and the subsequent re-heating rate, possibility of forming coarse Mg—Si compound is increased.

(Hot Rolling)

The hot rolling includes a rough rolling step and a finish rolling step of an ingot (slab) in accordance with the gauge of the plate to be rolled. In the rough rolling step or the finish rolling step, a reverse type or tandem type rolling mill is used properly.

In this case, under the condition where the hot rolling (rough rolling) start temperature exceeds the solidus line temperature, hot rolling per se becomes difficult since burning occurs. Further, if the hot rolling start temperature is lower than 350° C., load during hot rolling is excessively high making the hot rolling itself difficult. Accordingly, the hot rolling start temperature is defined as within a range of 350° C. to a solidus line temperature and, more preferably, within a range of 400° C. to the solidus line temperature.

(Annealing of Hot Rolled Plate)

While annealing of the hot rolled plate before cold rolling (coarse annealing) is not always necessary but this may be practiced for further improving the characteristics such as formability by refining the crystallized grains and optimizing the agglomerated microstructure.

(Cold Rolling)

In the cold rolling, the hot rolled plate is rolled to prepare a cold rolled plate (including coil) of a desired final plate gauge. However, for making the crystallized grains finer, the cold roll down ratio is preferably 60% or more and an intermediate annealing may also be applied between the cold rolling passes with the same purpose as that for the coarse annealing.

(Solution and Quenching Treatment)

After the cold rolling, solution and quenching treatments are applied. The solution treatment and the quenching treatment are not particularly restricted but heating and cooling by a usual continuous heat treatment line may be adopted. However, since it is desirable to obtain a sufficient solution amount for each of elements and that the crystallized grains are finer as described above, the treatments are preferably conducted by heating to a solution treatment temperature of 520° C. or higher and a melting temperature or lower at a heating rate of 5° C./sec or more and holding for 0 to 10 seconds.

Further, with a view point of suppressing the occurrence of coarse grain boundary compounds that may deteriorate the formability and the hem bendability, the average cooling rate from the solution temperature to the quench stopping temperature is preferably 3° C./s or more. If the cooling rate in the solution treatment is low, it is not possible to form the microstructure of the plate into a pre-structure in which precipitates of a fine size of 2.0 to 20 nm formed within the crystallized grains during the bake hardening treatment are present by a predetermined number density in the crystallized grains even when a pre-aging treatment to be described later is applied. Further, coarse $Mg_2Si$ and elemental Si are formed during cooling to deteriorate the formability. Further, the solution amount after the solution treatment is decreased and the BH response is also deteriorated. In order to ensure the cooling rate, air cooling by a blower, water cooling means such as mist, spray, immersion, etc. and conditions thereof are properly selected and used in the quenching treatment.

(Preliminary Aging Treatment)

Also, in order to improve the BH response further, the holding time at a room temperature from the end of the solution and quenching treatments to the start of the preliminary aging treatment (re-heating treatment) is preferably defined within 60 minutes. If the holding time at the room temperature is excessively long, the room temperature age hardening proceeds excessively and the microstructure of the plate cannot be formed into a pre-structure in which precipitates of a fine size of 2.0 to 20 nm formed in the crystallized grains during bake hardening treatment are present at a predetermined amount of the number density in the crystallized grains even when the pre-aging treatment is applied. Accordingly, a shorter holding time at the room temperature is more preferred and the solution and quenching treatments and the re-heating treatment may be in contiguous each other with a scarce time difference and the lower limit of the time is not particularly defined.

In the preliminary aging treatment (re-heating treatment), it is preferred that the reaching temperature of the plate (actual temperature) is within a temperature range of 80 to 150° C. and the holding time is 3 to 50 hr. If the reaching temperature of re-heating is 80° C. or lower or the holding time is 3 hr or shorter, the increasing amount of the strength upon BH (bake hardening treatment) (hardened amount) tends to be 100 MPa or less. In contrast, if the preliminary aging condition exceeds 150° C. or the holding time is 50 hours or larger, the yield strength before the bake hardening treatment tends to increase exceeding 100 MPa to deteriorate the formability.

The plate may be cooled to a room temperature after the preliminary aging treatment either by spontaneous cooling or compulsory cooling for efficient production by using the cooling means used for the quenching treatment. That is, since the clusters having equal or similar size defined in the present invention are formed completely by the temperature holding treatment, compulsory cooling as in the existent pre-aging treatment or the reheating treatment or complicate control of average cooling rate over a plurality of steps is not necessary.

The present invention is to be described more specifically with reference to examples but it is apparent that the present invention is not restricted by the following examples but can be practiced with an appropriate change within the range adaptable to the purpose of the invention to be described later, and any of them is included within the technical scope of the present invention.

EXAMPLE

Then, examples of the present invention are to be described. 6000-series aluminum alloy plates which are different in the composition and conditions of microstructure defined in the present invention were produced while changing the cooling rate of a quenching treatment after a solution treatment, the room temperature holding time from the end of solution and quenching treatments to the start of the preliminary aging treatment, and the temperature and the holding time of the preliminary aging treatment, etc. respectively. Then, the BH response of each of the examples after holding at a room temperature for 100 days (paint bake hardenability) was evaluated respectively. Also, hem bendability as the bendability was also evaluated together.

In the indication of the content for each of the elements in Table 1 showing the composition of 6000-series aluminum alloy plates of respective examples, indication of numerical values for each of the elements as blanks shows that the content is below a detection limit and the content of the element is substantially 0%.

Concrete production conditions of the aluminum alloy plates are as described below. Aluminum alloy ingots of each of the compositions shown in Table 1 were dissolved in common by a DC casting method. In this case, the average cooling rate during casting was 50° C./min from a liquidus line temperature to the solidus line temperature in common with each of the examples. Successively, after a soaking treatment of the ingots at 540° C.×4 hr in common with each of the examples, coarse hot rolling was started. Then, they were hot rolled to 3.5 mm gauge by subsequent finish rolling in common with each of the examples to form hot rolled plates. After coarsely annealing the aluminum alloy plates after hot rolling at 500° C.×1 minute in common with each of the examples, they were subjected to cold rolling at a rolling reduction of 70% with no intermediate annealing in the course of cold rolling pass and they were formed each into a cold rolled plate of 1.0 mm gauge in common with each of the examples.

Further, in common with each of the examples, the respective cold rolled plates were subjected to a solution treatment at 560° C. in a continuous heat treatment furnace, kept for 10 sec after reaching the aimed temperature and then immediately gas cooled or water cooled to a room temperature at various cooling rates shown in Tables 2 and 3. Then, as shown in Tables 2 and 3, after holding at the room temperature for 5 to 80 minutes, they were preliminarily aged under various temperature and holding conditions in an atmospheric furnace and then they were water cooled. In this example, while cooling is performed by water cooling after the re-heating treatment, similar microstructures can be obtained when the cooling is applied as spontaneous cooling.

Test specimen plates (blanks) were cut out from each of final plate products after being left for 100 days at a room temperature after the heat refining treatment, and characteristics for each of the test specimen plates were measured and evaluated. Further, observation of the microstructure using TEM was performed only for the specimens 100 days after the heat refining treatment. The results are shown in Tables 2 and 3. Alloy numbers in Table 1 and Tables 2 and 3 are corresponded each other.

(Fine Precipitates)

In each of the examples, after applying a heat treatment at 170° C. for 20 minutes to the test specimen plates, thin film test specimen sampled from a central portion of a cross section perpendicular to the rolling direction of the test specimen plate was prepared and a portion having a film thickness of 0.1 μm was measured in a range of 300 nm×300 nm×100 nm by using a transmission electron microscope at 300,000 magnifications under an acceleration voltage of 200 kV and an average number density of precipitates of a size of 2.0 to 20 nm ($N/m^3$) in the crystallized grains was measured. The observation was performed for five test specimens, and each of the number density of the precipitates of a size of 2.0 to 20 nm in the crystallized grains was determined respectively and averaged (as average number density). As described above, the size of the precipitates was measured by being converted as a diameter of a circle having an equivalent area.

(Paint Bake Hardenability)

After the heat refining treatment, 0.2% yield strength (As yield strength) was determined by a tensile test as a mechanical property of each of the test specimen plates after leaving for 100 days at a room temperature. Further, after subjecting each of the test specimen plates in common to a natural aging for 100 days, they were subjected to an artificial age hardening treatment at 170° C.×20 minutes (after BH), and 0.2% yield strength of the test specimen plates (yield strength after BH) was determined by a tensile test. Then, the BH response of each of the test specimen plates was evaluated based on the difference of 0.2% yield strengths to each other (increment of yield strength).

In the tensile stress test, No. 5 test specimens according to JIS Z 2201 (25 mm×50 mmGL×gauge) were sampled respectively from each of the test specimen plates and subjected to a tensile test at a room temperature. The tensile direction of the test specimen was perpendicular to the rolling direction. The tensile stress rate was 5 mm/min up to 0.2% yield strength and 20 mm/min after that yield strength. The number N in the measurement of mechanical property was defined as 5 and each was calculated as an average value. As the test specimen for yield strength measurement after BH, a 2% pre-strain simulating the press forming of the plate was given by the tensile tester and then the BH treatment was performed.

(Hem Bendability)

Hem bendability was tested on each of the test specimen plates after leaving for 100 days after the heat refining treatment. In the test, a rectangular test piece of 30 mm width was used. After 90° bending at 1.0 mm inner bending R by down flange, an inner of 1.0 mm thickness was interposed and further applied with pre-hemming of bending a bent portion to the inside by about 130 degree and a flat hemming of bending at 180 degree and closely joining the end to the inner successively.

The surface state of the bent portion of the flat hem (edge bent portion) such as occurrence of surface roughness, fine cracks and large cracks was observed with naked eyes and evaluated with naked eyes according to the following criterion.

0: with no cracks, surface roughening, 1: slight surface roughening, 2: deep surface roughening, 3: fine surface cracks, 4: linearly continuing surface cracks, 5: breaking.

Each of the examples of the invention was produced as shown by alloy numbers 0 to 9 in Table 1, numbers 0, 1, 7, 13 in Table 2, and numbers 19 to 24 in Table 3 respectively within a range of the component composition of the present invention and within a preferred range of conditions for the plate. Accordingly, each of the examples of the invention satisfies the definition for the microstructure after the heat treatment defined in the present invention as shown in Tables 2 and 3 respectively. That is, the number density of precipitates of a size of 2.0 to 20 nm in crystallized grains is $5.0\times10^{21}$ $N/m^3$ or more in average when the microstructure after applying a heat treatment to the produced plate at 170° C. for 20 minutes under the measuring condition of the TEM as described above.

As a result, in each of the examples of the invention, the yield strength can be 100 MPa or less even after long time natural aging of holding for 100 days at a room temperature and the increased amount of the yield strength (hardening amount, BH response) due to bake hardening is 90 MPa or more as shown in Tables 2 and 3 respectively. Accordingly, excellent BH response and hem bendability (formability) can be provided together as the characteristics after the natural aging.

In Comparative Examples 2 to 6, 8 to 12, and 14 to 18 of Table 2, alloy examples 1, 2, and 5 of the invention of Table 1 are used. However, as shown in Table 2, each of such comparative examples is out of preferred ranges for the cooling rate after the solution treatment, room temperature holding time till re-heating (pre-aging treatment) and re-heating condition (condition for pre-aging treatment). Accordingly, the number density of precipitates of a size of 2.0 to 20 nm in the crystallized grains is as small as less than $5.0\times10^{21}$ $N/m^3$ in average when measuring the microstructure after applying a heat treatment at 170° C. for 20 minutes under the measuring conditions of the TEM described above. As a result, the BH response and the hem bendability are poor compared with those of Examples 1, 2 and 5 of the invention.

In Comparative Examples 25 to 28 of Table 3, Mg and Si as main elements are out of the preferred range as shown by the alloy numbers 10 to 13 of Table 1. Accordingly, the BH response is insufficient or yield strength (strength) is excessively high and the hem bendability was also poor.

In Comparative Example 29 of Table 3, Mg and Si are out of the relation of the balance formula between each other defined in the present invention as shown by the alloy number 14 of Table 1. Accordingly, As yield strength after the room temperature holding for 100 days is excessively high and the hem bendability is poor.

Comparative Examples 30 and 31 of Table 3 do not contain Sn as shown by the alloy numbers 15, 16 of Table 1. Accordingly, natural aging cannot be suppressed sufficiently, and the As yield strength after the room temperature holding for 100 days is excessively high, and the hem bendability is poor.

Since comparative Example 32 of Table 3 contains excess Sn as shown in the alloy number 17 of Table 1, remarkable cracks occurred in hot working. Accordingly, subsequent survey has not been conducted.

In Comparative Examples 33 to 38 of Table 3, since contents of Fe, Mn, Cr, Zr, V, Ti, Cu, and Zn as other elements are excessive beyond the allowable amounts described above as shown by alloy numbers 18 to 23 in Table 1, hem bendability is poor.

The result of the examples described above supports the necessity of satisfying all of the conditions for the composition and the microstructure defined in the present invention for the improvement of the hem bendability and the BH response as the characteristic after the natural aging. Further, it also supports the critical meaning and the effect of preferred production conditions in the present invention for obtaining the hem bendability and the BH response after such natural aging.

TABLE 1

| Section | Alloy No. | Chemical composition of aluminum alloy plate (mass %, remainder Al) Mg | Si | Sn | Fe | Mn | Cr | Zr | V | Ti | Cu | Zn | Ag | Balance formula for Mg and Si 8 × (Mg content) − (Si content) |
|---|---|---|---|---|---|---|---|---|---|---|---|---|---|---|
| Example of Invention | 0 | 0.42 | 1.00 | 0.04 | | | | | | | | | | 2.36 |
| | 1 | 0.35 | 1.07 | 0.04 | 0.20 | | | | | | | | | 1.73 |
| | 2 | 0.32 | 0.61 | 0.04 | 0.20 | 0.12 | | | | | 0.2 | | | 1.95 |
| | 3 | 0.34 | 1.25 | 0.04 | 0.20 | | | 0.01 | | 0.06 | | | | 1.47 |
| | 4 | 0.45 | 0.63 | 0.04 | 0.20 | | | | | | 0.7 | | | 2.97 |
| | 5 | 0.48 | 1.02 | 0.04 | 0.20 | | | | | | 0.1 | | 0.1 | 2.82 |
| | 6 | 0.52 | 1.20 | 0.04 | 0.20 | 0.07 | | | | | | | | 2.96 |
| | 7 | 0.47 | 0.88 | 0.08 | 0.20 | | | | | | | 0.65 | | 2.88 |
| | 8 | 0.42 | 0.71 | 0.21 | 0.20 | | 0.2 | | 0.2 | | | | | 2.65 |
| | 9 | 0.38 | 1.23 | 0.04 | 0.90 | 0.7 | | 0.3 | | | 0.1 | | 0.01 | 1.81 |
| Comparative Example | 10 | 0.25 | 0.70 | 0.04 | 0.20 | | | | | | | | | 1.3 |
| | 11 | 0.65 | 1.10 | 0.04 | 0.20 | | | | | | | | | 4.1 |
| | 12 | 0.40 | 0.30 | 0.04 | 0.20 | | | | | | | | | 2.9 |
| | 13 | 0.32 | 1.45 | 0.04 | 0.20 | | | | | | | | | 1.11 |
| | 14 | 0.50 | 0.87 | 0.04 | 0.20 | | | | | | | | | 3.13 |
| | 15 | 0.41 | 1.00 | — | 0.20 | | | | | | | | | 2.28 |
| | 16 | 0.55 | 1.00 | — | 0.20 | | | | | | | | | 3.4 |
| | 17 | 0.42 | 1.03 | 0.38 | 0.20 | | | | | | | | | 2.33 |
| | 18 | 0.40 | 1.00 | 0.04 | 1.20 | | | | | | | | | 2.2 |
| | 19 | 0.42 | 1.03 | 0.04 | 0.20 | 1.1 | | | | | | | | 2.33 |
| | 20 | 0.38 | 1.05 | 0.04 | 0.20 | | 0.4 | | | | | | | 1.99 |
| | 21 | 0.40 | 1.02 | 0.04 | 0.20 | | | | | | 1.3 | | 0.01 | 2.18 |
| | 22 | 0.41 | 1.01 | 0.04 | 0.20 | | | | | 0.08 | | 1.2 | | 2.27 |
| | 23 | 0.39 | 1.03 | 0.04 | 0.20 | | | 0.4 | 0.4 | | | | | 2.09 |

TABLE 2

| Section | No. | Alloy No. of Table 1 | Average cooling rate in quenching treatment after solution treatment ° C./s | Time till starting re-heating after completion of quenching min | Re-heating condition Temperature ° C. | Re-heating condition Holding time h |
|---|---|---|---|---|---|---|
| Example of Invention | 0 | 0 | 20 | 5 | 100 | 5 |
| Example of Invention | 1 | 1 | 100 | 5 | 100 | 5 |
| Comparative Example | 2 | 1 | 100 | 80 | 100 | 5 |
| Comparative Example | 3 | 1 | 1 | 5 | 100 | 5 |
| Comparative Example | 4 | 1 | 100 | 5 | 70 | 5 |
| Comparative Example | 5 | 1 | 100 | 5 | 180 | 3 |
| Comparative Example | 6 | 1 | 100 | 5 | 100 | 1 |
| Example of Invention | 7 | 2 | 5 | 5 | 100 | 5 |
| Comparative Example | 8 | 2 | 100 | 80 | 100 | 5 |
| Comparative Example | 9 | 2 | 1 | 5 | 100 | 5 |
| Comparative Example | 10 | 2 | 100 | 5 | 70 | 5 |
| Comparative Example | 11 | 2 | 100 | 5 | 180 | 3 |
| Comparative Example | 12 | 2 | 100 | 5 | 100 | 1 |
| Example of Invention | 13 | 5 | 5 | 5 | 100 | 5 |
| Comparative Example | 14 | 5 | 100 | 80 | 100 | 5 |

TABLE 2-continued

| | | | | | | |
|---|---|---|---|---|---|---|
| Comparative Example | 15 | 5 | 1 | 5 | 100 | 5 |
| Comparative Example | 16 | 5 | 100 | 5 | 70 | 5 |
| Comparative Example | 17 | 5 | 100 | 5 | 180 | 3 |
| Comparative Example | 18 | 5 | 100 | 5 | 100 | 1 |

| | | Aluminum alloy plate characteristics after holding at room temperature for 100 days | | | | Number density of precipitates in a plate |
|---|---|---|---|---|---|---|
| Section | No. | As 0.2% yield strength MPa | 0.2% yield strength after BH MPa | Increase amount of yield strength MPa | Hem bendability | after heat treatment at 170° C. × 20 min after holding for 100 days at room temperature × $10^{21}$ N/m$^3$ |
| Example of Invention | 0 | 87 | 210 | 123 | 1 | 58.3 |
| Example of Invention | 1 | 84 | 202 | 118 | 1 | 44.1 |
| Comparative Example | 2 | 77 | 161 | 84 | 1 | 3.4 |
| Comparative Example | 3 | 72 | 150 | 78 | 3 | 3.8 |
| Comparative Example | 4 | 82 | 158 | 76 | 1 | 2.9 |
| Comparative Example | 5 | 162 | 197 | 35 | 3 | 1.2 |
| Comparative Example | 6 | 85 | 164 | 79 | 1 | 2.6 |
| Example of Invention | 7 | 84 | 192 | 108 | 1 | 24.1 |
| Comparative Example | 8 | 77 | 150 | 73 | 1 | 4.1 |
| Comparative Example | 9 | 78 | 146 | 68 | 3 | 2.8 |
| Comparative Example | 10 | 81 | 142 | 61 | 1 | 3.8 |
| Comparative Example | 11 | 160 | 183 | 23 | 3 | 1.2 |
| Comparative Example | 12 | 79 | 145 | 66 | 1 | 3.1 |
| Example of Invention | 13 | 95 | 226 | 131 | 1 | 66.2 |
| Comparative Example | 14 | 90 | 173 | 83 | 1 | 3.4 |
| Comparative Example | 15 | 87 | 168 | 81 | 3 | 3.8 |
| Comparative Example | 16 | 89 | 163 | 74 | 1 | 3.2 |
| Comparative Example | 17 | 168 | 217 | 49 | 3 | 2 |
| Comparative Example | 18 | 88 | 165 | 77 | 1 | 4.4 |

TABLE 3

| | | Alloy | Average cooling rate in quenching treatment after solution | Time till starting re-heating after completion of | Re-heating condition | |
|---|---|---|---|---|---|---|
| Section | No. | No. of Table 1 | treatment ° C./s | quenching min | Temperature ° C. | Holding time h |
| Example of Invention | 19 | 3 | 100 | 2 | 100 | 5 |
| Example of Invention | 20 | 4 | 100 | 45 | 100 | 5 |
| Example of Invention | 21 | 6 | 20 | 5 | 100 | 5 |
| Example of Invention | 22 | 7 | 10 | 5 | 100 | 5 |
| Example of Invention | 23 | 8 | 100 | 5 | 90 | 12 |
| Example of Invention | 24 | 9 | 100 | 5 | 120 | 3 |
| Comparative Example | 25 | 10 | 100 | 5 | 100 | 5 |
| Comparative Example | 26 | 11 | 100 | 5 | 100 | 5 |
| Comparative Example | 27 | 12 | 100 | 5 | 100 | 5 |
| Comparative Example | 28 | 13 | 100 | 5 | 100 | 5 |
| Comparative Example | 29 | 14 | 100 | 5 | 100 | 5 |
| Comparative Example | 30 | 15 | 100 | 5 | 100 | 5 |
| Comparative Example | 31 | 16 | 100 | 5 | 100 | 5 |
| Comparative Example | 32 | 17 | Crack occurred during hot rolling | | | |
| Comparative Example | 33 | 18 | 100 | 5 | 100 | 5 |
| Comparative Example | 34 | 19 | 100 | 5 | 100 | 5 |
| Comparative Example | 35 | 20 | 100 | 5 | 100 | 5 |
| Comparative Example | 36 | 21 | 100 | 5 | 100 | 5 |
| Comparative Example | 37 | 22 | 100 | 5 | 100 | 5 |
| Comparative Example | 38 | 23 | 100 | 5 | 100 | 5 |

| | | Aluminum alloy plate characteristics after holding at room temperature for 100 days | | | | Number density of precipitates in a plate |
|---|---|---|---|---|---|---|
| Section | No. | As 0.2% yield strength MPa | 0.2% yield strength after BH MPa | Increase amount of yield strength MPa | Hem bendability | after heat treatment at 170° C. × 20 min after holding for 100 days at room temperature × $10^{21}$ N/m$^3$ |
| Example of Invention | 19 | 88 | 196 | 108 | 1 | 14.5 |
| Example of Invention | 20 | 82 | 187 | 105 | 1 | 22.4 |
| Example of Invention | 21 | 92 | 225 | 133 | 1 | 31.7 |

TABLE 3-continued

| | | | | | | |
|---|---|---|---|---|---|---|
| Example of Invention | 22 | 93 | 217 | 124 | 1 | 36.5 |
| Example of Invention | 23 | 86 | 213 | 127 | 1 | 33.8 |
| Example of Invention | 24 | 97 | 210 | 113 | 1 | 29.5 |
| Comparative Example | 25 | 77 | 130 | 53 | 1 | 3.3 |
| Comparative Example | 26 | 124 | 255 | 131 | 2 | 98.6 |
| Comparative Example | 27 | 73 | 134 | 61 | 1 | 3.5 |
| Comparative Example | 28 | 96 | 215 | 119 | 3 | 39.7 |
| Comparative Example | 29 | 117 | 222 | 105 | 2 | 59.1 |
| Comparative Example | 30 | 117 | 215 | 98 | 2 | 61.2 |
| Comparative Example | 31 | 133 | 226 | 93 | 2 | 43.9 |
| Comparative Example | 32 | Crack occurred during hot rolling | | | | — |
| Comparative Example | 33 | 95 | 189 | 94 | 3 | 21.5 |
| Comparative Example | 34 | 103 | 190 | 87 | 3 | 24.2 |
| Comparative Example | 35 | 96 | 178 | 82 | 3 | 17.3 |
| Comparative Example | 36 | 124 | 228 | 104 | 3 | 40.7 |
| Comparative Example | 37 | 97 | 182 | 85 | 3 | 25.1 |
| Comparative Example | 38 | 93 | 181 | 88 | 3 | 20.4 |

While the present invention has been described specifically with reference to specific embodiments, it will be apparent to a person skilled in the art that various changes or modifications can be adopted without departing the gist and the scope of the present invention.

The present application is based on Japanese Patent Application filed on Feb. 26, 2013 (Japanese Patent Application No. 2013-035986), the content of which is incorporated herein as a reference.

INDUSTRIAL APPLICABILITY

The present invention can provide a 6000-series aluminum alloy plate having excellent hem bendability and BH response as characteristics after aging at a room temperature. As a result, application of the 6000-series aluminum alloy plate can be extended to members or parts of transporting machineries such as automobiles, ships or vehicles and domestic electric appliances, buildings and structures and, in particular, to members for transporting machineries such as automobiles.

The invention claimed is:

1. An Al—Mg—Si series alloy plate, comprising

Mg: 0.3 to 0.6 mass %,

Si: 0.4 to 1.4 mass %,

Sn: 0.01 to 0.3 mass %, wherein 8×(Mg content)−(Si content)≤3.0, and

Al, and unavoidable impurities, wherein the alloy plate has a microstructure comprising a number density of precipitates of a size from 2.0 to 20 nm of $5.0\times10^{21}$ N/m$^3$ or more in average measured by subjecting the alloy plate to artificial aging at 170° C. for 20 minutes and within a range of 300 nm×300 nm×100 nm under a transmission electron microscope of 300,000 magnifications at a central portion of a cross section perpendicular to a rolling direction of the plate.

2. The alloy plate according to claim 1, further comprising one or more of Mn in an amount greater than 0 mass % up to not more than 1.0 mass %, Cu in an amount of greater than 0 mass % up to not more than 1.0 mass %, Fe in an amount of greater than 0 mass % up to not more than 1.0 mass %, Cr in an amount of greater than 0 mass % up to not more than 0.3 mass %, Zr in an amount of greater than 0 mass % up to not more than 0.3 mass %, V in an amount of greater than 0 mass % up to not more than 0.3 mass %, Ti in an amount of greater than 0 mass % up to not more than 0.1 mass %, Zn in an amount of greater than 0 mass % up to not more than 1.0 mass %, and Ag in an amount of greater than 0 mass % up to not more than 0.2%.

3. The alloy plate of claim 1, comprising Mg in an amount of 0.32 to 0.52 mass %.

4. The alloy plate of claim 1, comprising Si in an amount of 0.63 to 1.2 mass %.

5. The alloy plate of claim 1, comprising Sn in an amount of 0.04 to 0.21 mass %.

6. The alloy plate of claim 1, comprising Mg in an amount of 0.32 to 0.52 mass %, Si in an amount of 0.63 to 1.2 mass %, and Sn in an amount of 0.04 to 0.21 mass %.

7. The alloy plate of claim 1, wherein the number density of precipitates of a size from 2.0 to 20 nm is of $5.0\times10^{21}$ N/m$^3$ to $33.8\times10^{21}$ N/m$^3$ in average.

8. The alloy plate of claim 1, wherein the number density of precipitates of a size from 2.0 to 20 nm is of $5.0\times10^{21}$ N/m$^3$ to $36.5\times10^{21}$ N/m$^3$ in average.

9. The alloy plate of claim 6, wherein the number density of precipitates of a size from 2.0 to 20 nm is of $5.0\times10^{21}$ N/m$^3$ to $31.7\times10^{21}$ N/m$^3$ in average.

* * * * *